US006685304B2

(12) United States Patent
Miyamoto

(10) Patent No.: US 6,685,304 B2
(45) Date of Patent: Feb. 3, 2004

(54) PRINTER, PRINTER HEAD AND METHOD OF PRODUCING THE PRINT HEAD TO PROMOTE RELIABLE BONDING OF PRINT HEAD STRUCTURES

(75) Inventor: Takaaki Miyamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 110 days.

(21) Appl. No.: 10/053,468

(22) Filed: Nov. 7, 2001

(65) Prior Publication Data

US 2002/0126182 A1 Sep. 12, 2002

(30) Foreign Application Priority Data

Nov. 7, 2000 (JP) ..... P2000-344227

(51) Int. Cl.[7] ..... B41J 2/05; H05B 3/00
(52) U.S. Cl. ..... 347/63; 347/65; 29/611
(58) Field of Search ..... 347/63, 65, 67, 347/44, 47, 56, 61, 64, 58, 391, 57; 29/890.1, 611

(56) References Cited

U.S. PATENT DOCUMENTS 4,866,460 A * 9/1989 Shiozaki ..... 347/58
4,926,197 A * 5/1990 Childers et al. ..... 347/63
5,943,076 A * 8/1999 Burke et al. ..... 347/64
6,079,811 A 6/2000 Cornell et al. ..... 347/48
6,126,272 A 10/2000 Ahn ..... 347/54
6,126,276 A 10/2000 Davis et al. ..... 347/65
6,328,428 B1 * 12/2001 Keefe et al. ..... 347/63

FOREIGN PATENT DOCUMENTS

JP 1005995 6/2000 ..... B41J/2/16

* cited by examiner

*Primary Examiner*—Juanita Stephens
(74) *Attorney, Agent, or Firm*—Sonnenschein, Nath & Rosenthal LLP

(57) ABSTRACT

A printer, a printer head, and a method of producing the printer head in which ink drops are caused to flow out by heat, so that an orifice plate can be bonded by sufficiently bringing it into close contact with that to which it is to be bonded. The printer head is formed by successively placing predetermined materials upon each other on a semiconductor substrate of a semiconductor device, and at least one of the lamination materials placed upon each other on the semiconductor substrate is smooth so that a surface where a plate-shaped material forming a nozzle is disposed is smooth.

19 Claims, 5 Drawing Sheets

PRINTER, PRINTER HEAD AND METHOD OF PRODUCING THE PRINT HEAD TO PROMOTE RELIABLE BONDING OF PRINT HEAD STRUCTURES

RELATED APPLICATION DATA

The present application claims priority to Japanese Application(s) No(s). P2000-344227 filed Nov. 7, 2000, which application(s) is/are incorporated herein by reference to the extent permitted by law.

BACKGROUND OF THE INVENTION

1. Field of the Invention

The present invention relates to a printer, a printer head, and a method of producing the printer head. In particular, the present invention is applicable to a printer which makes use of a process that causes ink droplets to fly out as a result of heating by a heater.

2. Description of the Related Art

In recent years, in the field of image processing and the like, there has been an increasing need for color hard copies. To respond to this need, there has been conventionally proposed a sublimation thermal transfer process, a fusion thermal transfer process, an inkjet process, an electrophotographic process, a thermally processed silver process, and the like.

In the inkjet process, a dot is formed by causing small drops of recording liquid (ink) to fly out from a nozzle of a recording head and causing them to adhere to what is to be subjected to a recording operation. This makes it possible to output a high-quality image using a simple structure. The inkjet process is classified into, for example, an electrostatic attraction process, a continuous vibration generation process (piezo process), and a thermal process, depending on the method used to cause the ink to fly out.

In the thermal process, air bubbles are produced by heating localized portions of the ink in order to push out the ink from a discharge opening by the air bubbles, thereby causing the ink to fly out to what is to be subjected to printing. This makes it possible to print a color image using a simple structure.

A printer which operates by this thermal process is constructed using what is called a printer head, which has mounted therein a heating element which heats ink, a drive circuit based on a logic integrated circuit which drives the heating element, and other component parts.

FIG. 5 is a sectional view partly showing a thermal head. In forming a printer head 1, an isolation area 3 (LOCOS: local oxidation of silicon) which isolates transistors is formed on a P-type silicon substrate 2, and, for example, a gate oxide film is formed at a transistor formation area remaining between portions of the isolation area 3, thereby forming MOS (metal oxide semiconductor) switching transistors 4 and MOS transistors 5 and 6 forming a drive circuit.

Next, in forming the printer head 1, after placing, for example, an insulating film, a contact hole is formed in order to form a first-layer wiring pattern 7. By the first-layer wiring pattern 7, the MOS transistors 5 and 6, forming the drive circuit, are connected to each other, thereby forming a logic integrated circuit.

Next, in forming the printer head 1, after, for example, the insulating film has been placed, sputtering is carried out in order to deposit heating element materials, such as tantalum, tantalum aluminum, or titanium nitride, in order to form resistance films in localized portions. By the resistance films, heating elements 8 which heat ink are formed.

Next, in forming the printer head 1, a contact hole is formed to form a second-layer wiring pattern 9. By the second-layer wiring pattern 9, a connection portion between the switching transistors 4 and the heating elements 8, a connection portion between the heating elements 8 and a power supply, a ground line, and the like, are formed.

Next, in forming the printer head 1, an insulating material, such as $SiO_2$ or SiN, is deposited in order to form a protective layer 10, after which a Ta film is formed on localized portions of the heating elements 8. By the Ta film, a cavitation resistance layer 11 is formed. Next, a dry film 13 and an orifice plate 14 are successively placed upon each other. Here, the dry film 13 is formed of, for example, carbon resin, which is hardened to a predetermined shape and film thickness so that a partition of an ink path and an ink chamber is formed with a predetermined height. On the other hand, the orifice plate 14 is formed of a plate-shaped material which is processed into a predetermined shape so that a nozzle 15, which is a very small ink discharge opening, is formed above the heating elements 8. The orifice plate 14 is supported on the top portion of the dry film 13 as a result of adhering it thereto. When the above-described operations are carried out, the nozzle 15, an ink chamber 16, a path for guiding ink into the ink chamber 16, etc., are formed at the printer head 1.

In the printer head 1, the ink is guided to the ink chamber 16, and, by a switching operation of the switching transistors 4, the heating elements 8 generate heat in order to heat localized portions of the ink. By the heating, core air bubbles are produced at side surfaces of the heating elements 8 of the ink chamber 16. These core air bubbles combine to form film air bubbles. When pressure is increased by the air bubbles, the ink is pushed out from the nozzle 15 and flies out to what is to be subjected to printing. As a result, in a printer using the printing head 1, intermittent heating by the heating elements 8 causes the ink to successively adhere to what is to be subjected to printing, so that a desired image is formed.

Further, in the printer head 1, the switching transistors 4, which drive the heating elements 8, are controlled by the same logic integrated circuit formed by the MOS transistors 5 and 6. Therefore, the heating elements 8 are disposed very closely together, thereby making it possible to reliably drive them by their corresponding switching transistors 4.

In other words, in order to obtain a high-quality printed result, the heating elements 8 need to be disposed very close to each other. More specifically, in order to obtain, for example, a 600 DPI printed result, the heating elements 8 need to be disposed at intervals of 42,333 $\mu$m. It is extremely difficult to dispose individual drive elements at the heating elements 8 disposed very close to each other. Therefore, in the printer head 1, for example, switching transistors are formed on the semiconductor substrate and are connected to the corresponding heating elements 8 by an integrated circuit technology. Then, by the drive circuits similarly formed on the semiconductor substrate, the corresponding switching transistors are driven in order to make it possible to simply and reliably drive each of the heating elements 8.

However, the printer head 1 having such a structure has a problem in that it is difficult to bring the orifice plate 14 sufficiently into close contact with the dry film 13 and to bond it thereto.

More specifically, in a commonly used semiconductor integrated circuit, the first-layer wiring pattern 7 is formed with the minimum thickness required, and the second-layer wiring pattern 9, which forms a power supply line and a ground line, is made thick in order to obtain a desired current capacity.

In contrast to this, in the printer head 1, the situation is reversed with respect to the case of the commonly used semiconductor integrated circuit, so that the first-layer wiring pattern is made thick, whereas the second-layer wiring pattern is made thin, in order to obtain good covering property at the silicon nitride film forming the ink protective layer 10 and the tantalum cavitation resistance layer 11, which are formed above the heating elements 8.

In the printer heat 1, by virtue of such a structure, the second-layer wiring pattern is formed with a thickness of the order of 1 $\mu$m when an aluminum wiring pattern is used, and a stepped portion having a size of the order of 1 $\mu$m is formed at the second-layer wiring pattern 9. In this way, when the stepped portion having a size of the order of 1 $\mu$m is formed at the second-layer wiring pattern 9, very fine recesses and protrusions are formed at the surface of the protective layer 10, which is formed on top of the wiring pattern 9, and the surface of the dry film 13. Because of the very fine recesses and protrusions, it becomes difficult to bring the orifice plate 14 sufficiently into close contact with the dry film 13 and to bond it thereto. In this connection, when the surfaces of the protective layer 10 and the dry film 13 become very uneven, ink leakage may occur.

SUMMARY OF THE INVENTION

In view of the above-described points, it is an object of the present invention to provide a printer in which an orifice plate can be bonded by bringing it sufficiently into close contact with what it is to be bonded to, a printer head, and a method of producing the printer head.

In order to overcome the above-described problems, the present invention is applied to the printer or the printer head, and at least one of lamination materials that are placed upon each other on a semiconductor substrate which is smoothened so that a surface at which a plate-shaped material is disposed becomes smooth.

The present invention is applied to a method of producing the printer head. The method comprises the step of smoothening at least one of the lamination materials placed upon each other on the semiconductor substrate so that the surface where the plate-shaped material is disposed becomes smooth.

According to the structure of the present invention, by smoothening at least one of the lamination materials placed upon each other on the semiconductor substrate so that the surface where the plate-shaped material is disposed becomes smooth, it is possible to dispose the plate-shaped material on a smooth surface. This makes it possible to bond the orifice plate by bringing it sufficiently into close contact with what it is to be bonded to.

According to the structure of the present invention, it is possible to produce the printer head by bonding the orifice plate by bringing it sufficiently into close contact with what it is to be bonded to.

DESCRIPTION OF THE PREFERRED EMBODIMENT

Hereunder, a description of an embodiment of the present invention will be given in detail with reference to the drawings when necessary.

(1) Structure of the Embodiment

Figure 1A:
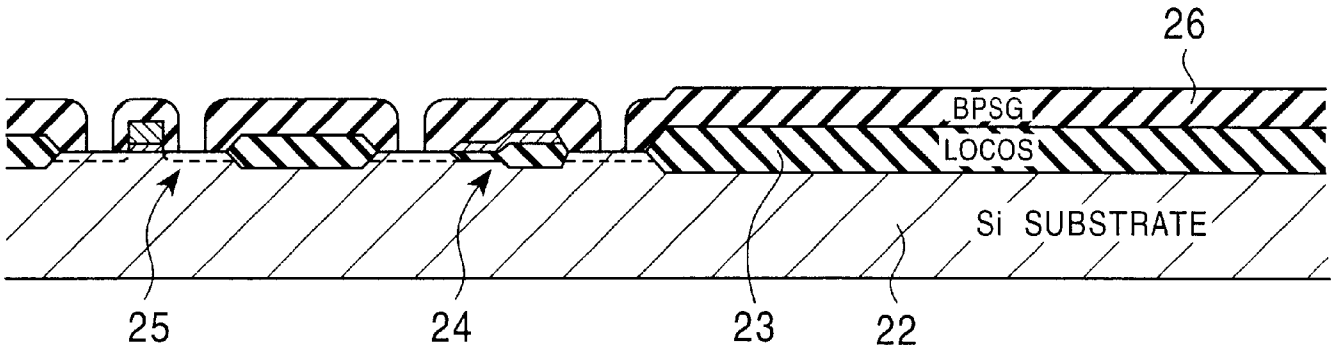
FIGS. 1A and 1B are sectional views illustrating steps of producing a printer head of an embodiment of the present invention.

FIGS. 1A to 4B are sectional views illustrating the steps of producing a printer head of an embodiment of the present invention. In the production process, as shown in FIG. 1A, after washing a P-type silicon substrate 22, silicon nitride films are deposited thereon. In the process, by lithography and reactive ion etching, the silicon substrate 22 is processed in order to remove the silicon nitride films deposited on areas other than predetermined areas where transistors are formed. By these operations, in the production process, silicon nitride films are formed in the areas on the silicon substrate 22 where the transistors are to be formed.

Then, in the production process, by a thermal oxidation operation, thermal silicon oxide films are formed in the areas from which the silicon nitride films have been removed, and, by the thermal silicon oxide films, an isolation area (LOCOS) 23 for isolating the transistors is formed. Thereafter, in the production process, after washing the silicon substrate 22, gates having tungsten silicide/polysilicon/thermally oxide film structures are formed. Thereafter, by heat-treatment and ion implantation for forming source drain areas, the silicon substrate 22 is processed in order to form, for example, MOS switching transistors 24 and 25. Here, the switching transistor 24 is a MOS driver transistor having a pressure resistance of the order of 30 V, and is used to drive heating elements. On the other hand, the transistor 25 forms an integrated circuit that controls the driver transistor, and operates by a voltage of 5 V. Then, in the process, by CVD (chemical vapor deposition), a BPSG (borophosepho silicate glass) film 26 is deposited in order to form an interlayer insulating film.

Figure 1B:
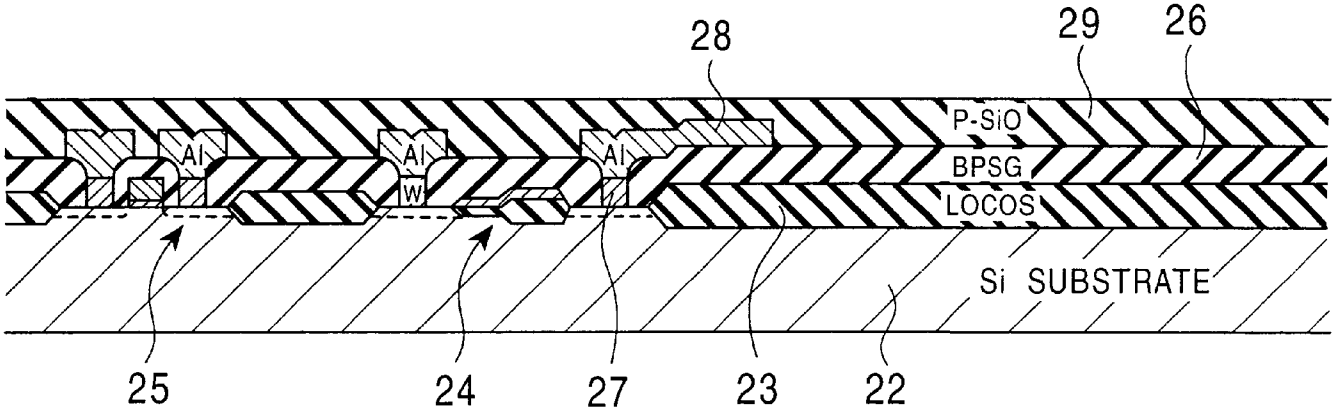

Next, in this process, as shown in FIG. 1B, by photolithography and reactive ion etching using CFx gas, a connection hole (contact hole) is formed at a silicon semiconductor diffusion layer (source drain). The silicon substrate 22 is washed using rare fluorinated acid. By sputtering, a titanium film having a thickness of 20 nm and a titanium nitride barrier metal having a thickness of 50 nm are successively deposited. By CVD using WF6 as a source gas, tungsten is embedded in the connection hole.

In this process, excess tungsten and titanium nitride that have been deposited on the portions of the interlayer film other than the portion where the connecting hole is formed are removed by dry etching using SF6 gas or C12 gas. With the tungsten remaining in the connection hole, a contact 27 is formed. Then, in this process, aluminum to which 0.5% of copper has been added is deposited to a film thickness of 600 nm. Thereafter, photolithography and dry etching are carried out to form a first-layer wiring pattern 28. In the process, by the first-layer wiring pattern 28, the MOS transistor 25, forming a drive circuit, is connected in order to form a logic integrated circuit.

Then, in the process, a silicon oxide film 29 (what is called TEOS), which is an interlayer insulating film, is deposited by CVD in order to, by CMP (chemical mechanical polishing), smooth the silicon oxide film 29. Accordingly, in the process, the protrusions and recesses formed by first layer the wiring pattern 28 as well as by the transistors 24 and 25 and the contact 27 are such that they do not appear at the top surface of the silicon oxide film 29.

Figure 2A:
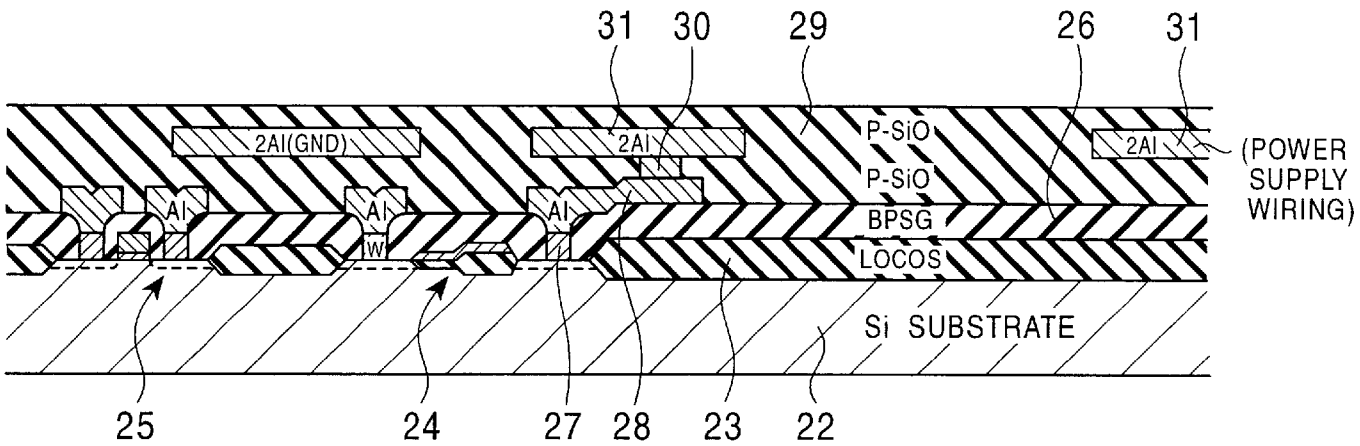
FIGS. 2A and 2B are sectional views illustrating steps following those illustrated in FIGS. 1A and 1B.

Next, in this process, as shown in FIG. 2A, photolithography and dry etching are carried out to form a connection hole (via hole) following the formation of the first-layer wiring pattern 28 formed of aluminum. Then, as in the case of the first layer wiring pattern, tungsten is embedded in the connection hole. Thereafter, by sputtering, a titanium film having a thickness of 10 nm and a titanium nitride film having a thickness of 50 nm are successively deposited, after which aluminum to which 0.5% of copper has been added is deposited to a film thickness of 600 nm. Accordingly, in this process, a wiring film 30 formed of aluminum is formed.

In this process, by photolithography and dry etching, the aluminum wiring film 30 is processed in order to form a second-layer wiring pattern 31. In this process, by the second-layer wiring pattern 31, a power supply wiring pattern and a ground wiring pattern are formed, and a wiring pattern for connecting the drive transistor 24 to the heating elements is formed.

Next, in this process, by CVD, a silicon oxide film 32, which is an interlayer insulating film, is deposited, and is smoothened by CMP. Therefore, in this process, the recesses and protrusions of the wiring pattern 31 are such as not to appear at the top surface of the silicon oxide film 32.

Figure 2B:
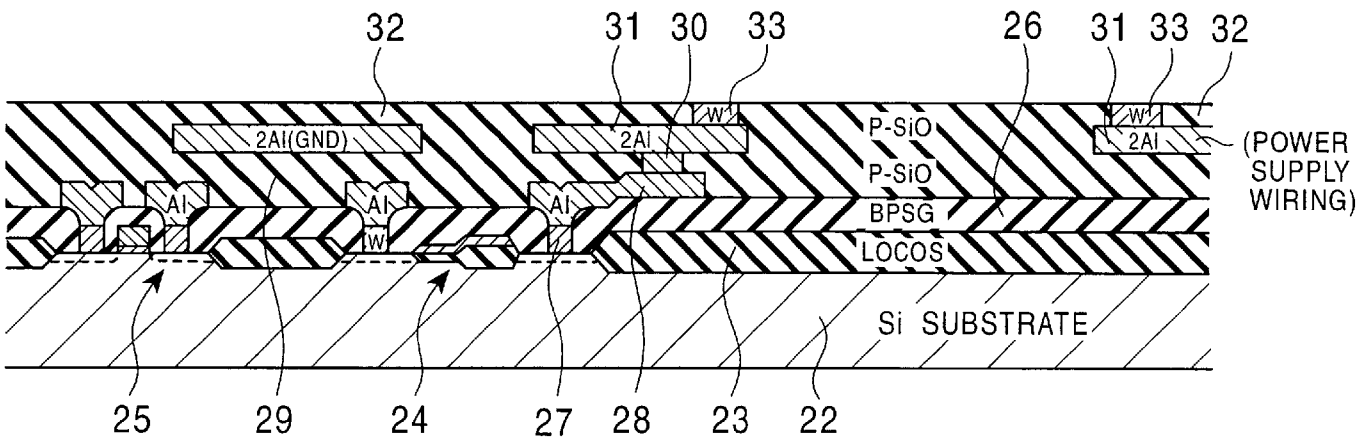

Next, in the process, as shown in FIG. 2B, photolithography and dry etching are carried out to form a connection hole (via hole) following the formation of the second-layer wiring pattern 31. Then, as in the case of the first layer wiring pattern 28, tungsten is embedded in the connection hole in order to form a tungsten plug 33 for connecting the heating elements.

Figure 3A:
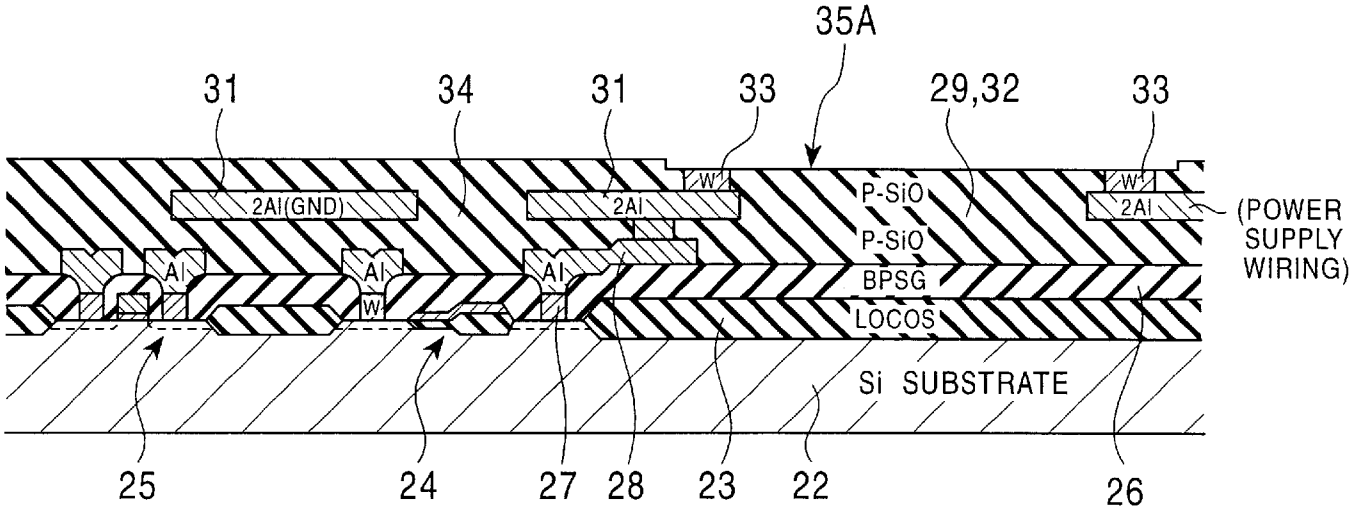
FIGS. 3A and 3B are sectional views illustrating steps following those illustrated in FIGS. 2A and 2B.

Next, in this process, as shown in FIG. 3A, by CVD, a silicon oxide film 34, which is an interlayer insulating layer, is then deposited, and is smoothened by CMP. Then, by photolithography and dry etching, a groove 35A having a depth of 60 nm to 100 nm for embedding resistors of the heating elements is formed in the interlayer film 34, which is a silicon oxide film. Here, the groove 35A is formed so that the tungsten plug 33 is exposed.

Figure 3B:
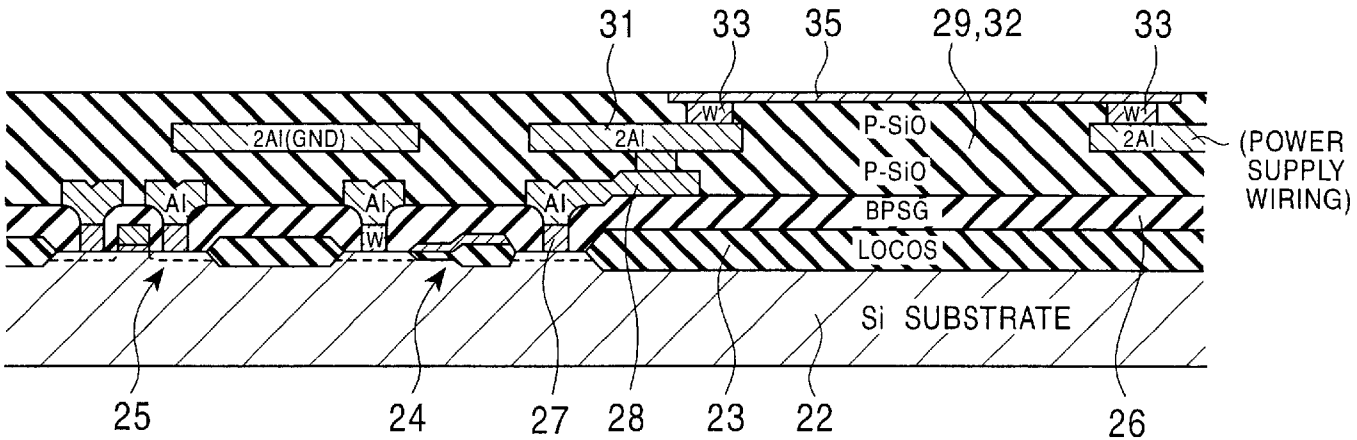

Next, in the process, as shown in FIG. 3B, after a titanium film having a thickness of 10 nm has been deposited by sputtering, either titanium nitride or tantalum is deposited until the groove 35A is completely filled with it. Here, the titanium serves as a closely contacting layer of the titanium nitride film or the tantalum film. Thereafter, in this process, CMP using polishing materials containing an oxidizing agent is carried out to remove the titanium nitride film or the tantalum film from the silicon oxide film by polishing, so that the titanium nitride film or the tantalum film remains only in the groove 35A. Therefore, in this process, heating elements 35 are formed by embedding the resistors in the groove 35A so that the recesses and protrusions do not appear at the top side thereof, and, through the tungsten plug 33, the heating elements 35 are such as to be connected to the switching transistor 24 and the power supply.

Accordingly, in this process, the heating elements 35 are disposed at the top side of the second-layer wiring pattern 31, and the distance from the heating elements 35 to an ink chamber is made small, so that heat generated by the heating elements 35 can be correspondingly efficiently conducted to the ink chamber. By smoothening some of the layers below the heating elements 35, it is possible to correspondingly prevent, for example, breakage of wires of the heating elements 35.

Figure 4A:
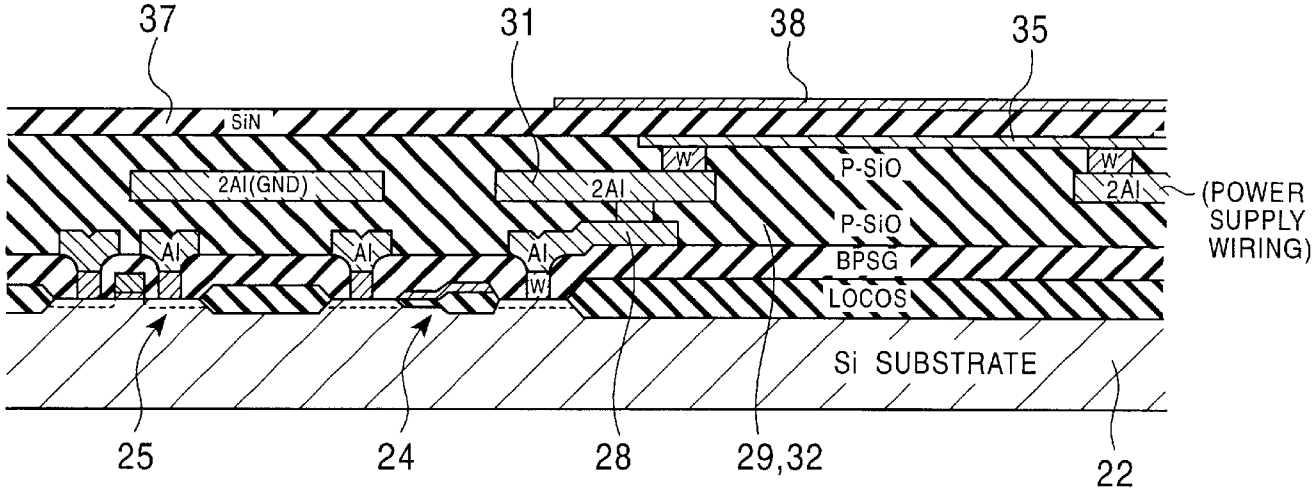
FIGS. 4A and 4B are plan views illustrating steps following those illustrated in FIGS. 3A and 3B.

Next, in this process, as shown in FIG. 4A, a silicon nitride film 37, which functions as an ink protective layer, is deposited to a film thickness of 300 nm above each of the heating elements 35. Then, by sputtering, a tantalum film having a thickness of 200 nm is deposited in order to form a cavitation resistance layer 38 by the tantalum film. Here, some of the layers below the cavitation resistance layer 38 are smoothened, and the cavitation resistance layer 38 is formed to a thickness of 200 nm, so that the cavitation resistance layer 38 is formed on a considerably smoother surface at the top surface than are conventional cavitation resistance layers. Accordingly, by forming the cavitation resistance layer 38 on such a smoothened surface, in the embodiment, the cavitation resistance layer 38 can be made more reliable than conventional cavitation resistance layers.

Figure 4B:
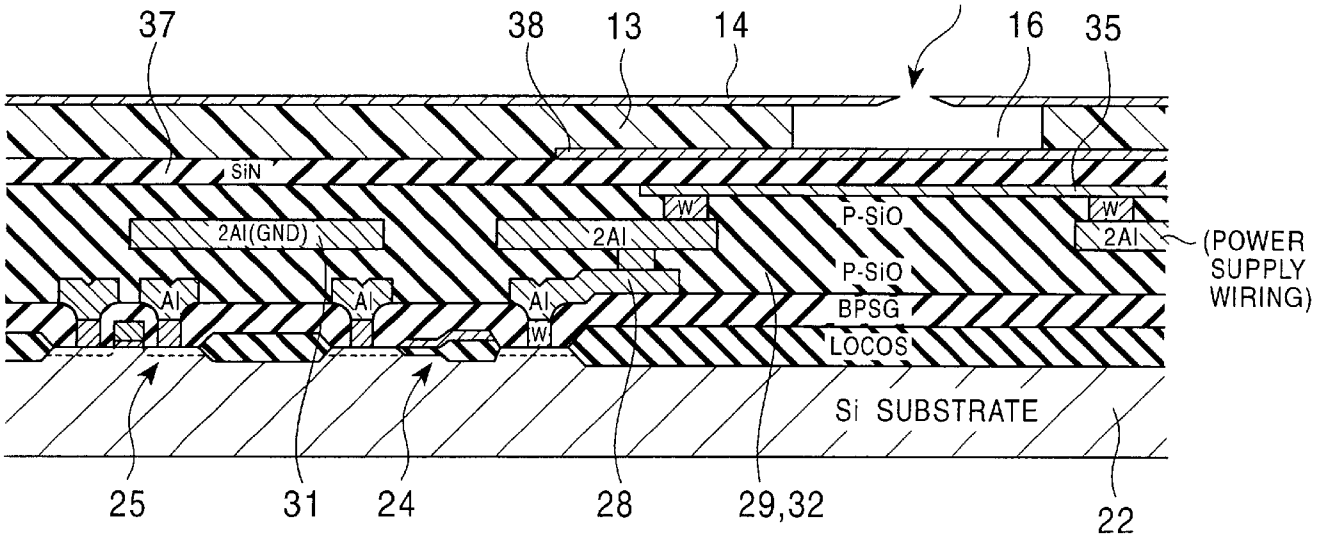
Figure 5:
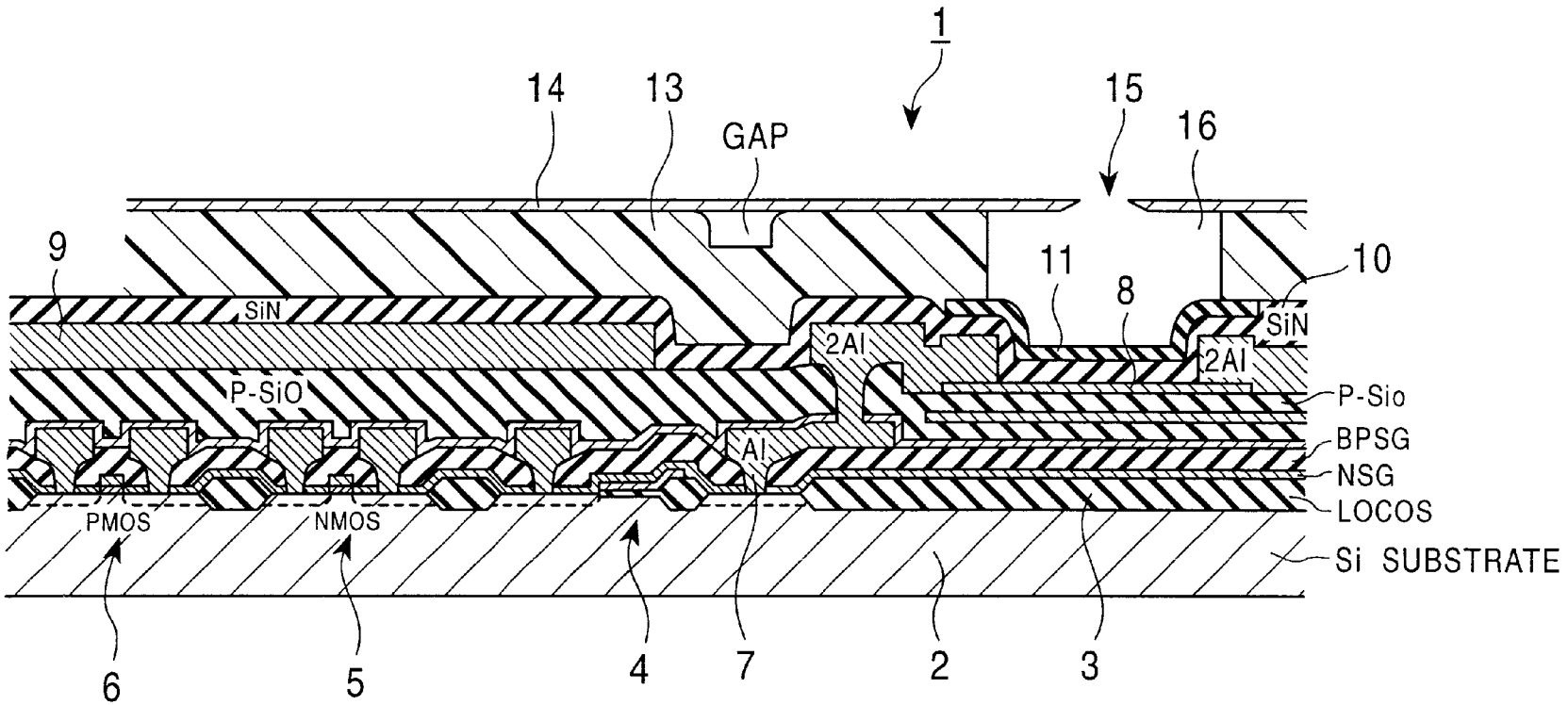
FIG. 5 is a sectional view of a conventional printer head.

Next, in the process, as shown in FIG. 4B, an orifice plate 14 and a dry film 13, formed of carbon resin, are successively placed. By the dry film 13 and the orifice plate 14, an ink chamber 16, a path which guides ink into the ink chamber 16, and a nozzle 15 are formed. In this case, the smoothened layers below the dry film 13 are formed considerably smoother than the layers below conventional dry films, so that the orifice plate 14 can be brought sufficiently into close contact with the dry film 13 in order to bond it thereto.

(2) Operation

In the obtained above-described structure, in the process of producing a printer head of the embodiment, the semiconductor substrate 22 is processed, so that the semiconductor substrate 22 having the transistors 24 and 25 disposed thereon (as shown in FIG. 1A) is formed. The interlayer insulating films 29, 31, etc., the wiring patterns 28 and 32, the dry film 13, the orifice plate 14, etc., are successively placed upon each other on the semiconductor substrate 22 in order to produce the printer head (as shown in FIGS. 1B to 4B).

In the production process, when the lamination materials are successively placed upon each other, the interlayer insulating films are smoothened by CMP, so that the dry film 13 is placed on a smooth surface, after which the orifice plate 14 is bonded to the dry film 13. Accordingly, in this production process, the lamination materials that are placed upon each other on the semiconductor substrate 22 are smoothened for production, so that the orifice plate 4 can be bonded to a smooth surface, brought sufficiently into close contact with the smooth surface, and supported by the smooth surface. Therefore, in the production process, sufficient strength can be ensured, and an accident, such as leakage of ink, can be prevented from occurring.

By smoothening each of the interlayer insulating films 29, 32, the resistors of the heating elements 35 and the cavitation resistance layer 38 can be formed on smooth surfaces, thereby making it possible to ensure that the heating elements 35 and the cavitation resistance layer 38 are satisfactorily reliable.

By performing such smoothening operations, when the heating elements 35 are formed on the second-layer wiring pattern 31, the heating elements 35 can be formed on a smooth surface. Therefore, in this production process, the heating elements 35 are disposed at the top portion side of the second-layer wiring pattern 31 and near the ink chamber 16, so that it is possible to correspondingly efficiently heat the ink.

When the heating elements 35 are disposed in this manner, in the production process, the groove 35A is formed and has a resistance material embedded therein in order to dispose the heating elements 35. Accordingly, in the production process, even when the heating elements 35 are disposed, very fine recesses and protrusions are prevented from being formed at the surface where the orifice plate 14 is disposed, so that the orifice plate 14 is correspondingly sufficiently brought into close contact with the dry film 13 and is disposed.

Accordingly, in the printer head of the embodiment, it is possible to sufficiently bring the orifice plate 14 into close contact with the dry film 13 in order to be bonded thereto, so that it is possible to correspondingly satisfactorily make the orifice plate 14 more reliable. It is possible to ensure that a printer using the printer head is sufficiently reliable.

(3) Advantages of the Embodiment

According to above-described structure, predetermined materials are successively placed upon each other on the semiconductor substrate 22 of a semiconductor device. At this time, by smoothening at least one of the lamination materials that are placed upon each other on the semiconductor substrate 22 so that the surface where the plate-shaped material forming a nozzle 15 is disposed is smooth, the orifice plate 14 can be brought sufficiently into close contact with the dry film 13 in order to be bonded thereto.

When what is to be smoothened is one of the interlayer insulating films 29, 32, which are layers that are placed upon each other below the lamination materials making up the wall surfaces of the ink path and the ink chamber 16, it is possible to easily process the material to be smoothened by CMP, which is a semiconductor production technology.

In addition, when the lamination layers to be smoothened are the interlayer insulating films 29, 32, the heating elements 35 and the cavitation resistance film 38 are formed on smooth surfaces, thereby making it possible to increase reliability.

When this is done, in the case where the printer head includes multiple layers of wiring patterns, even when the heating elements 35 are formed by forming resistance films on the top side of the wiring pattern at the topmost layer, the heating elements 35 are formed on a smooth surface, thereby making it possible to ensure satisfactory reliability. Therefore, the heating elements 35 are disposed at the top side of the wiring pattern at the topmost layer, so that, while maintaining sufficient reliability, the ink in the ink chamber 16 can be efficiently heated.

By forming the heating elements 35 using shapes formed by forming a groove in an interlayer insulating film and embedding the resistance films in the groove 35A, it is possible to prevent the production of recesses and protrusions formed by the heating elements 35, thereby making it possible to more sufficiently bring the orifice plate 14 into close contact with the dry film 13 in order to bond it thereto.

(4) Other Forms

Although in the above-described embodiment the case where the heating elements are disposed using the shapes formed by forming a groove in an interlayer insulating film and embedding resistance films in the groove has been described, the present invention is not limited thereto, so that, when the orifice plate can be bonded to a surface which is sufficiently smooth for practical purposes, such an operation can be omitted.

Although in the above-described embodiment the case where each interlayer insulating film is smoothened has been described, the present invention is not limited thereto. The point is that as long as the surface to which the orifice plate is bonded is sufficiently smooth for practical purposes, the orifice plate can be bonded to the surface by sufficiently bringing it into close contact with this surface. Therefore, when necessary, when, for example, the interlayer insulating film at the topmost layer alone is to be smoothened, it is possible to omit any one of the other smoothening operations in the above-described embodiment when necessary.

Although in the above-described embodiment the case where a structure having two layers of wiring patterns has been described, the present invention is not limited thereto, so that the present invention may be widely applied to, for example, a structure having one layer of wiring pattern or a structure having three of more layers of wiring patterns.

Although in the above-described embodiment the case where the heating elements are disposed on the top side of the wiring pattern at the topmost layer has been described, the present invention is not limited thereto, so that the present invention may be widely applied to, for example, the case where the heating elements are disposed at the bottom side of the wiring pattern at the topmost layer.

Although in the above-described embodiment the case where, for example, the heating elements are formed using tantalum films has been described, the present invention is not limited thereto, so various other types of lamination materials may be used when necessary.

What is claimed is:

1. A printer for performing a printing operation in which ink drops are caused to fly out of a printer head as a result of driving of a heating element disposed in the printer head, the printer comprising:

the printer head wherein predetermined lamination materials are successively placed upon each other on a semiconductor substrate of a semiconductor device in order to form the heating element, the heating element being formed at a top side of multiple layers of wiring patterns to form a resistance film, a drive circuit which drives the heating element, a wall surface of an ink chamber which holds ink so that the ink is heated by the heating element, and another wall surface of an ink path used to guide the ink to the ink chamber; wherein a predetermined plate-shaped material is disposed in order to form the ink chamber, the ink path, and a nozzle, the nozzle being used to guide the ink in the ink chamber to the outside, and at least one of the lamination materials placed upon each other on the semiconductor substrate is smooth so that a surface where the plate-shaped material is to be disposed is smooth.

2. A printer according to claim 1, wherein what is to be smoothened is a surface of a layer below the lamination material forming the wall surface of the ink chamber and the wall surface of the ink path.

3. A printer according to claim 1, wherein what is to be smooth is an interlayer insulating film.

4. A printer according to claim 1, wherein the heating element is formed by a shape formed by forming a groove in an interlayer insulating film and embedding the resistance film in the groove.

5. A printer head used to perform a printing operation by causing ink drops to fly out as a result of driving a heating element, wherein, predetermined lamination materials are successively placed upon each other on a semiconductor substrate of a semiconductor device in order to form the heating element, the heating element being formed at a top side of multiple layers of wiring patterns to form a resistance film, a drive circuit which drives the heating element, a wall surface of an ink chamber which holds ink so that the ink is heated by the heating element, and a wall surface of an ink path used to guide the ink to the ink chamber;

a predetermined plate-shaped material is disposed in order to form the ink chamber, the ink path, and a nozzle, the nozzle being used to guide the ink in the ink chamber to the outside; and at least one of the lamination materials placed upon each other on the semiconductor substrate is smoothened so that a surface where the plate-shaped material is to be disposed is smooth.

6. A printer head according to claim 5, wherein what is to be smoothened is a surface of a layer below the lamination material forming the wall surface of the ink chamber and the wall surface of the ink path.

7. A printer head according to claim 5, wherein what is to be smoothened is an interlayer insulating film.

8. A printer head according to claim 5, wherein the heating element is formed by a shape formed by forming a groove in an interlayer insulating film and embedding a resistance film in the groove.

9. A method of producing a printer head used to perform a printing operation y causing ink drops to fly out as a result of driving a heating, the method comprising:

a first lamination step in which predetermined lamination materials are successively placed upon each other on a semiconductor substrate of a semiconductor device in order to form the heating element, the method further comprising the step of providing multiple layers of wiring patterns, and wherein the first lamination step comprises forming the heating element at a top side of the wiring patterns at the topmost layer by forming a resistance film, a drive circuit which drives the heating element, a wall surface of an ink chamber which holds ink so that the ink is heated by the heating element, and another wall surface of an ink path used to guide the ink to the ink chamber;

a second lamination step in which a predetermined plate-shaped material is disposed in order to form the ink chamber, the ink path, and a nozzle, the nozzle being used to guide the ink in the ink chamber to the outside; and a smoothening step in which at least one of the lamination materials placed upon each other on the semiconductor substrate is smoothened so that a surface where the plate-shaped material is disposed is smooth.

10. A method of producing a printer head according to claim 9, wherein the smoothening step comprises smoothening a surface of a layer below the lamination material forming the wall surface of the ink chamber and the wall surface of the ink path.

11. A method of producing a printer head according to claim 9, wherein the smoothening step comprises smoothening an interlayer insulating film.

12. A method of producing a printer head according to claim 9, wherein the first lamination step comprises forming the heating element by a shape formed by forming a groove in an interlayer insulating film and embedding a resistance film in the groove.

13. A printer head, comprising:

a substrate;

at least one wiring pattern disposed above the substrate;

at least one insulation layer disposed on top of the at least one wiring pattern, the at least one insulation layer having a smooth surface via a process wherein the smooth surface eliminates irregularities of the at least one wiring pattern;

a heater element disposed planarly on a top side of the topmost layer of the at least one wiring pattern via the smooth surface to form a resistance film;

a dry film disposed on top of the heater element; and an orifice plate disposed on top of the dry film wherein the orifice plate is planarly bonded to the dry film.

14. The printer head according to claim 13, wherein the process is a chemical mechanical polish.

15. The printer head according to claim 13, wherein the irregularities comprise at least one of a protrusion and recess.

16. A method of manufacturing a printer head, comprising:

forming a substrate;

disposing at least one wiring pattern on the substrate;

disposing a least one insulation layer on the at least one wiring pattern;

removing irregularities of the at least one wiring pattern by smoothing the at least one insulation layer;

disposing a heater element on the ton side of the topmost layer of the at least one insulation layer to form a resistance film;

disposing a dry film on top of the heater element; and planarly bonding an orifice plate to the dry film.

17. The method according to claim 16, further comprising applying a chemical mechanical polish to the a least one insulation layer.

18. The method according to claim 16, further comprising forming a groove in the at least one insulation layer.

19. The method according to claim 16, further comprising planarly positioning the heater element in the groove to prevent breakage of the heater element.

* * * * *